US006210143B1

(12) United States Patent
Takagi et al.

(10) Patent No.: US 6,210,143 B1
(45) Date of Patent: Apr. 3, 2001

(54) APPARATUS FOR PRODUCING YARNS WITH YARN CUTTING AND SUCKING UNITS

(75) Inventors: Jun Takagi, Otsu; Katsumi Hasegawa, Kusatsu, both of (JP)

(73) Assignee: Toray Engineering Co., Ltd., Osaka (JP)

( * ) Notice: Subject to any disclaimer, the term of this patent is extended or adjusted under 35 U.S.C. 154(b) by 0 days.

(21) Appl. No.: 09/164,770

(22) Filed: Oct. 1, 1998

(30) Foreign Application Priority Data

Oct. 2, 1997 (JP) ..... 9-287829

(51) Int. Cl.[7] ..... D01D 5/00

(52) U.S. Cl. ..... 425/142; 425/382.2; 425/464

(58) Field of Search ..... 425/72.2, 66, 142, 425/378.2, 382.2, 464; 264/177.17, 210.8, 211.14, 39

(56) References Cited

U.S. PATENT DOCUMENTS 3,719,442 * 3/1973 Schippers et al. ..... 425/66
4,522,774 * 6/1985 Donnelly et al. ..... 264/168
5,419,110 * 5/1995 Mikami et al. ..... 57/261
5,794,868 * 8/1998 Busenhart et al. ..... 242/35.5 R

FOREIGN PATENT DOCUMENTS 52-24129 * 6/1977 (JP) .

* cited by examiner

*Primary Examiner*—Harold Pyon
*Assistant Examiner*—Joseph S Del Sole
(74) *Attorney, Agent, or Firm*—Burns, Doane, Swecker & Mathis, L.L.P.

(57) ABSTRACT

An apparatus for producing yarns comprising a first yarn feeding roller, a second yarn feed roller, winders for winding the respective yarns, yarn breakage detectors and detect yarn breakage, and yarn cutting and sucking devices disposed upstream from the yarn feed rollers and operative in response to a yarn breakage detection signal to cut the group of yarns being wound to which the broken yarn belongs. The respective one yarn cutting and sucking device and the respective one winder form winding units, respectively, and at least two such winding units share at least one of the yarn feed rollers. Therefore, it is possible to increase the yield of yarns.

10 Claims, 8 Drawing Sheets

APPARATUS FOR PRODUCING YARNS WITH YARN CUTTING AND SUCKING UNITS

BACKGROUND OF THE INVENTION

1. Field of the Invention

The present invention relates to an apparatus for producing yarns of, for example, synthetic fibers.

2. Description of the Related Art

An apparatus for producing yarns, in which spun yarns are wound in the form of packages, includes a first yarn feed roller 11 and a second yarn feed roller 12 for feeding the yarns spun through spinnerets of spinning packs 5 to 10 in a spinning apparatus and cooled by a cooling device (not shown) at a predetermined rate, winders 1-A and 1-B for winding the yarns on tubes, yarn breakage detectors 15-A and 15-B for detecting that at least one yarn which is being wound by the winder 1-A or 1-B has broken, and a yarn cutting and sucking device 17 disposed upstream from the yarn feed roller 11, which is operative in response to a yarn breakage detection signal to cut all yarns being wound and suck the same, as shown in FIG. 7.

In the apparatus described above, if at least one yarn in the yarn group is broken for any reasons, the yarn breakage is detected by the yarn breakage detector 15-A which issues a detection signal. Then, the yarn cutting and sucking device 17 is rapidly operated, by this signal, to cut all the yarns being wound via the first feed roller 11 and the second feed roller 12 by the winders 1-A and 1-B and suck the same thereinto, to prevent the yarns from being adversely wound around the first yarn feed roller 11, the second yarn feed roller 12 and the winders 1-A and 1-B, which may result in an abnormality in the spinning operation.

In the above-mentioned method, wherein all the yarns are cut if only one yarn in the group belonging to one winder has broken, the yarns normally wound by another winder without yarn breakage must be cut, resulting in the reduction of yield of yarns as well as an increase in a burden on the operator caused by the threading operation.

SUMMARY OF THE INVENTION

The object of the present invention is to prevent a reduction in the yield of yarns and to prevent the operator's burden from increasing due to the threading operation which results from the fact that yarns of a normally operating winder having no yarn breakage are cut.

To solve the above problems, the present invention provides an apparatus for producing yarns wherein the respective one yarn cutting and sucking device and the respective one winder form one winding unit, and at least two winding units share at least one of the yarn feed rollers.

Additionally, the winders may be arranged in vertical row.

Also, a yarn path control guide may be provided for guiding yarns in such a manner that upon the threading operation of the rear side yarn group across the front side yarn group, due to an occurrence of yarn breakage or the like in the rear side yarn group, the rear side yarn group is moved from the front side region to the rear side region of the first common yarn feed roller while passing under or over the front side yarn group running through the first common yarn feed roller and then moved over or under the second yarn group running through the second common yarn feed roller.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
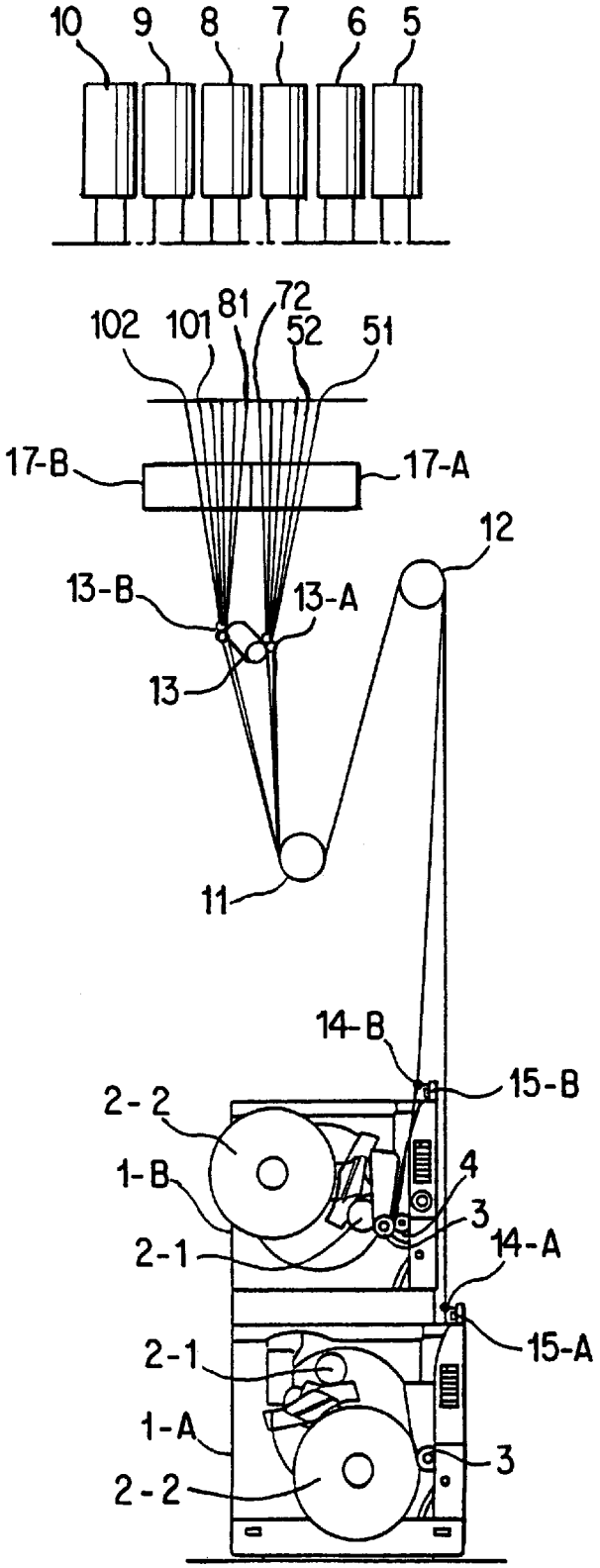
FIG. 1 is a schematic front view of one embodiment of an apparatus for producing yarns according to the present invention.
Figure 2:
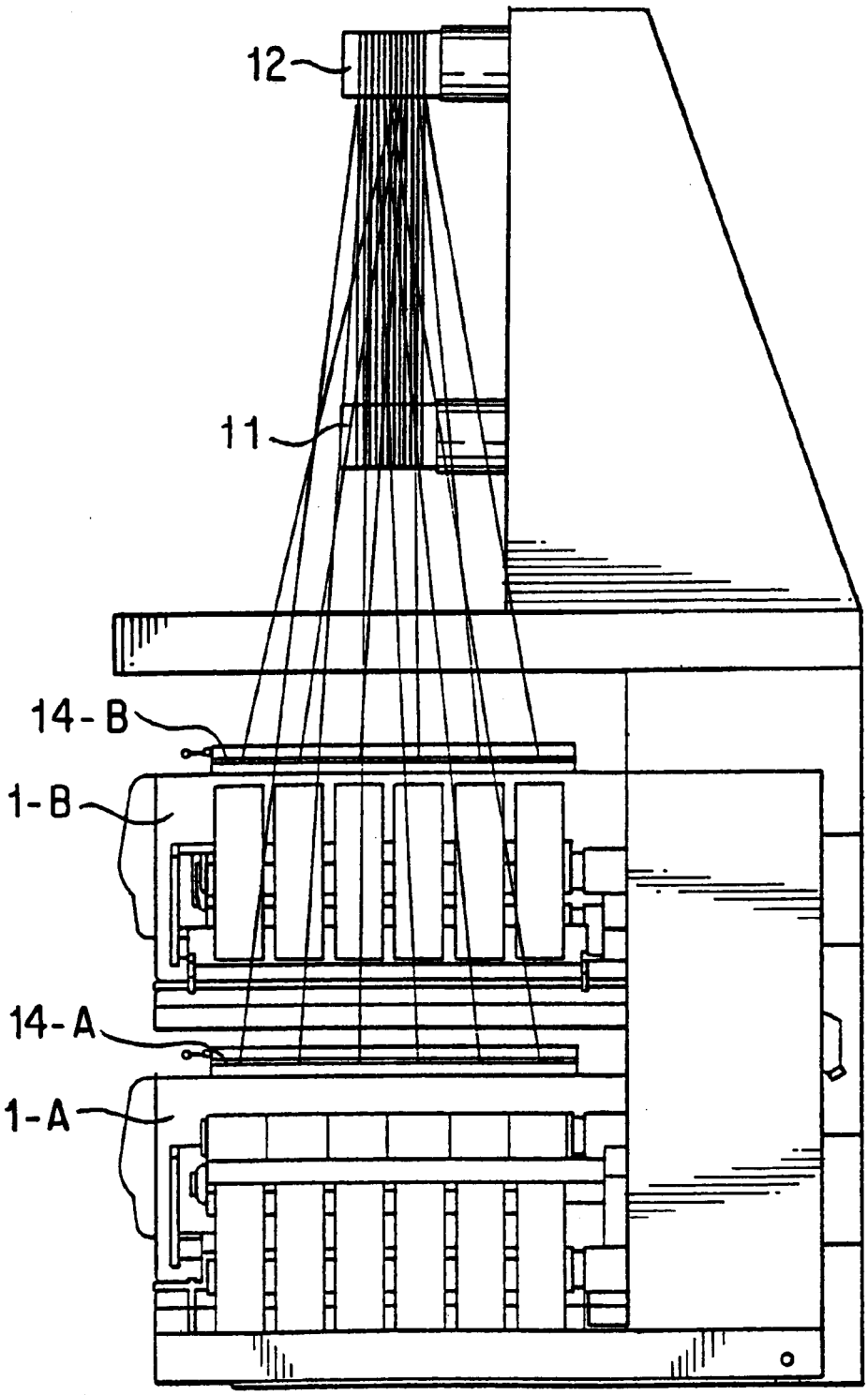
FIG. 2 is a schematic side view of the apparatus shown in FIG. 1, illustrating a portion below the first yarn feed roller.

FIG. 1 is a schematic front view of one embodiment of an apparatus for producing yarns according to the present invention, and FIG. 2 is a schematic side view thereof, wherein the apparatus for producing yarns includes a spinning device (not shown) for extruding molten polymer through spinnerets of spinning packs 5 to 10, a yarn cooling device (not shown) disposed beneath the yarn spinning packs 5 to 10, a first yarn feed roller 11 and a second yarn feed roller 12 for feeding the cooled yarn at a predetermined rate, winders 1-A and 1-B for winding the yarns on tubes, a yarn breakage detector 15-A for detecting the yarn breakage corresponding to any one of the yarns 51, 52, 61, 62, 71 and 72 being wound on the winder 1-A, a yarn breakage detector 15-B for detecting the yarn breakage corresponding to any one of the yarns 81, 82, 91, 92, 101 and 102 being wound on the winder 1-B, yarn cutting and sucking devices 17-A and 17-B disposed upstream from the first yarn feed roller 11 and operative in response to a yarn breakage signal to cut and suck all the yarns in a group to which the broken yarn detected by the yarn breakage detector belongs, a yarn separating guide 13 disposed beneath the yarn cutting and sucking devices 17-A and 17-B, for dividing the yarns into two groups and guide the same, and traverse motion fulcrum guides 14-A and 14-B disposed above the respective winders 1-A and 1-B.

Each of the winders 1-A and 1-B is provided with a traverse motion device 4 for traversing the yarn, a pair of spindles 2-1 and 2-2 for winding the yarn thereon alternately with each other, a roller bail 3 for applying a proper pressure to a surface of a package formed on the spindle to make the package to have a flat and uniform surface and a suitable hardness, and a yarn switching device (not shown) for switching the yarn from a full package tube to a waiting empty tube when the package has reached a predetermined size. Such winders are superposed in a vertical row, one above another, for the purpose of saving an installation space as much as possible relative to the number of yarns to be wound.

Pairs of yarns 51, 52 . . . , and 101, 102, extruded from spinnerets of each of the spinning packs 5 to 10, respectively, are cooled and solidified by the yarn cooling device (not shown) disposed directly beneath the spinnerets. After being imparted with process oil, the respective yarns are delivered to predetermined positions on the first yarn feed roller 11 and the second yarn feed roller 12 by the yarn separating guide 13, via the yarn cutting and sucking devices 17-A and 17-B for treating the group of yarns, respectively, to cut and suck the same in response to the operation of the yarn breakage detectors 15 which are provided for every yarn to quickly detect any breakage of yarns due to an abnormality in the process and to deliver the signal to the control unit. The yarns are finally wound by the winders via the traverse motion fulcrum guides 14.

The yarn separating guide 13 may be formed of a first set of guides 13-A and a second set of guides 13-B corresponding to the winders 1-A and 1-B, when the function thereof is divided.

In this case, the traverse motion fulcrum guide 14-A or the yarn to be wound by the lower winder 1-A is disposed far from the second yarn feed roller 12, and the traverse motion fulcrum guide 14-B for the yarn to be wound by the upper winder I-B is disposed close to the second yarn feed roller 12.

In this respect, the yarn separating guide 13 (13-A and 13-B), a first yarn path control guide 16 having third 16-A and fourth 16-B sets of guides, a second yarn path control guide 18 having fifth 18-B and sixth 18-A sets of guides, and the traverse motion fulcrum guide 14 (14-A and 14-B) may be arranged in such a manner that they can be pulled forward during the threading operation and returned to the original position after the yarns have been threaded to the respective guides.

More specifically, six yarns 51, 52, 61, 62, 71, and 72 extruded from the spinning packs 5 to 7 run through the yarn cutting and sucking device 17-A, while six yarns 81, 82, 91, 92, 101, and 102 extruded from the spinning packs 8 to 10 run through the yarn cutting and sucking device 17-B.

The yarns 51, 52, 61, 62, . . . 91, 92, 101, and 102 run through the yarn separating guide 13 and maintain the positions arranged in this order. Such positions are invariable even on the first yarn feed roller 11 and the second yarn feed roller 12, whereby the yarns 51 to 72 are wound by the lower winder 1-A and the yarns 81 to 102 are wound by the upper winder 1-B, via the traverse motion fulcrum guides 14-A and 14-B, respectively.

It will be understood that the winder 1-A is combined with the yarn cutting and sucking device 17-A, while the winder 1-B is combined with the yarn cutting and sucking device 17-B to form winder units, respectively. Accordingly, if the yarn 92 is broken during the winding operation of the winder 1-B, the yarn breakage detector 15-B provided in correspondence to the yarn 92 detects the breakage and informs the same to a controller (not shown). The controller promptly causes the corresponding yarn cutting and sucking device 17-B to operate to cut yarns 81 to 102 belonging to the same group as the yarn 92 and suck the same thereinto so that no trouble occurs in the yarn spinning system now in operation. At this instant, all the yarns being wound by the winder I-B are severed.

In some cases, there might be an extremely small amount of yarn piece which is wound around the first yarn feed roller 11 or the second yarn feed roller 12 at a position corresponding to the running path of the broken yarn 92. This yarn piece is easily displaceable to the front side (to the distal end of the roller), using a bamboo spatula or the like to remove the yarn piece from the roller without causing a trouble with another group of the yarn 51 to 72 being wound. Therefore, even if the winding operation of the one winder 1-B is interrupted due to the yarn breakage, the other winder 1-A continues a normal winding operation.

Upon the yarn breakage, the tubes in the winder 1-B carrying incomplete packages thereon must be exchanged with fresh empty tubes, on which the spun yarns must be immediately threaded. At that time, the group of yarns 51 to 72 which are continuously wound by the winder 1-A are running through the front side region of the first and second yarn feed rollers 11 and 12. Therefore, the group of yarns 81 to 102 must slip into the rear side region of the first and second yarn feed rollers 11 and 12 and pass through the predetermined positions on the rollers without disturbing the running of the group of yarns 51, to 72.

Figure 8:
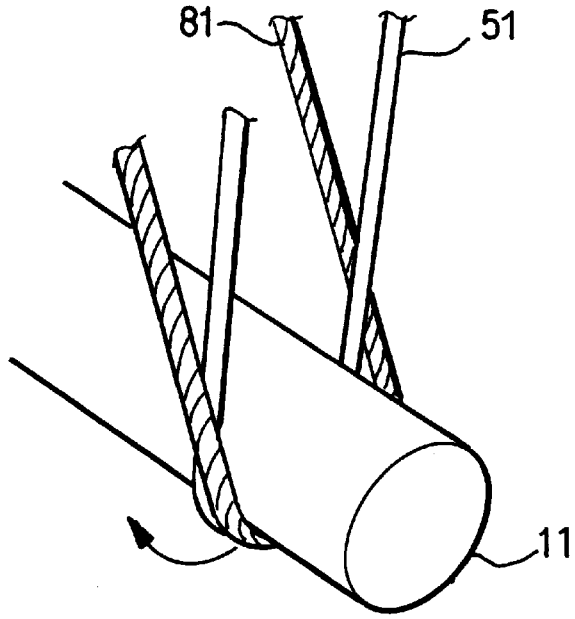
FIG. 8 is a view of the manner in which a yarn from a group of yarns is laterally moved over another yarn from another group of yarns.
Figure 9:
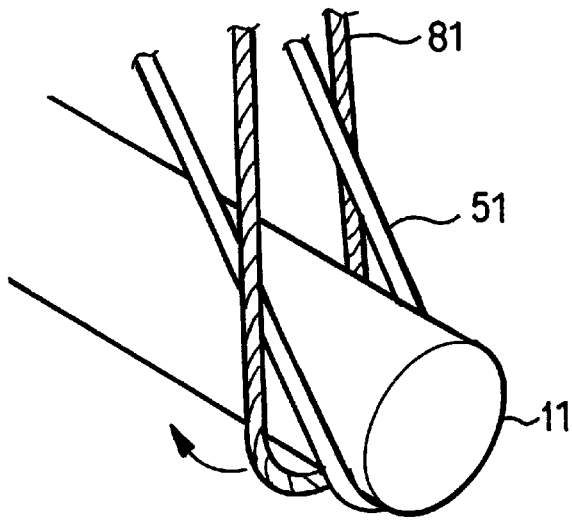
FIG. 9 is a view of the manner in which a yarn from a group of yarns is laterally moved underneath another yarn from group of yarns.

It might be questioned if such a threading operation is possible. However, it is possible under the following conditions:

First, the group of yarns 81 to 102 which are being sucked into the yarn cutting and sucking device 17-B are sucked together by a suction gun (not shown). The respective yarns are individually separated by the yarn separating guide 13 to be located at predetermined positions. While maintaining such a condition, the suction gun is displaced in the running direction of the yarn feed rollers, so that after the gun passes through the second yarn feed roller 12, yarn suction nozzles of the suction gun (not shown) reach a point beneath the group of yarns subjected to the normal winding operation, i.e., a point on the side of the traverse motion fulcrum guide 14-B, then, the respective yarns are automatically positioned in the order defined by the yarn separating guide 13. That is, as seen in FIG. 8, on the first yarn feed roller 11, the group of yarns to be threaded, in this case the second group of yarns (only yarn 81 is shown), laterally move over the group of yarns subjected to the normal winding operation, the first group of yarns (only yarn 51 is shown), and enter the rear side region. Meanwhile, on the second yarn feed roller 12, the group of yarns to be threaded laterally move under the group of normal yarns and enter the rear side region. Since both groups of yarns run at the same speed and at an angle, the yarns are immediately positioned at the normal positions without the occurrence of tangling or any filament breakage in the respective yarn. FIG. 9 illustrates the condition in which the first group of yarns (only yarn 51 is shown) is laterally moved underneath the second group of yarns (only yarn 81 is shown).

In such a manner, the winding operation is started again on the winder 1-B.

By the way, it realizes the same effect to use the method of polymer stop by a gear pump (not shown), without the yarn cutting and sucking device 17.

Figure 3:
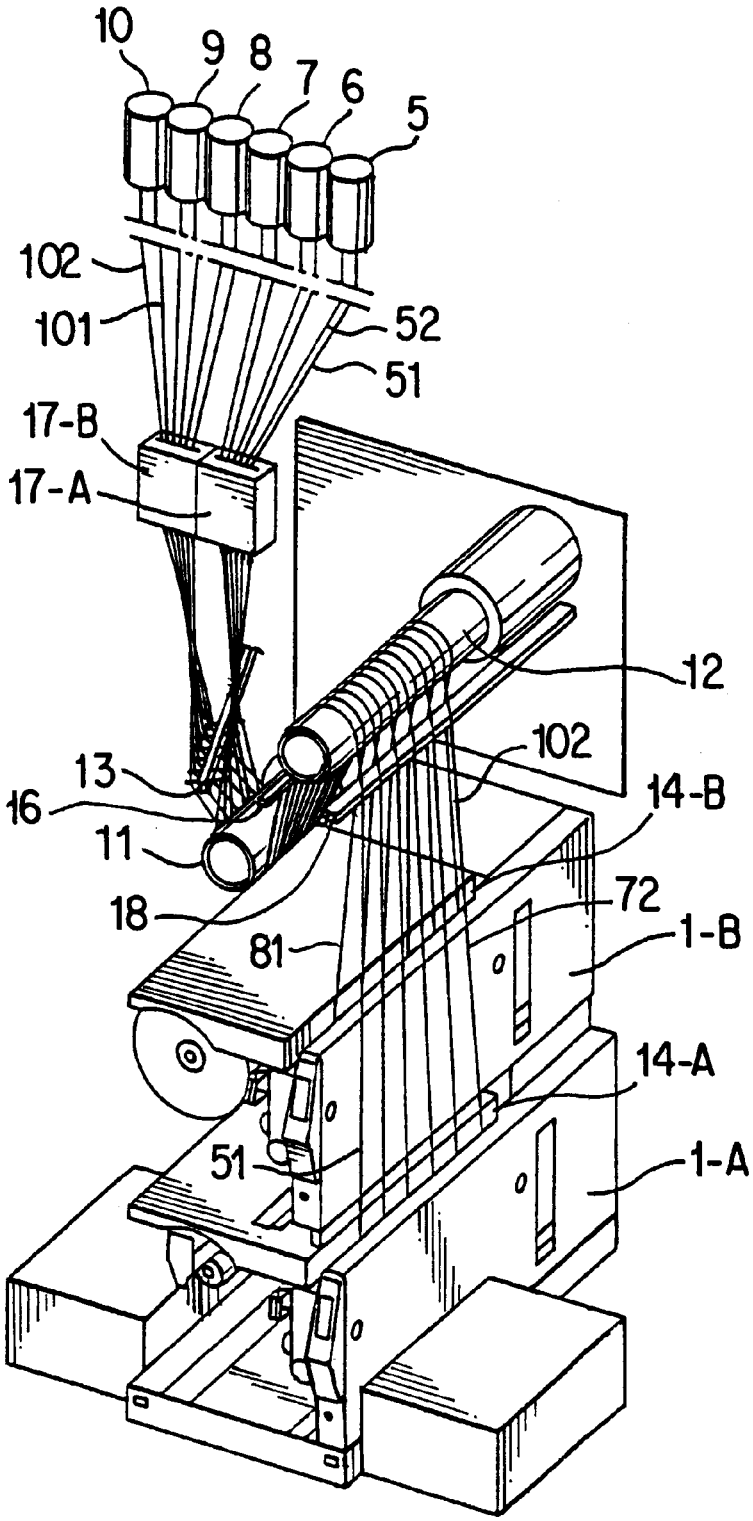
FIG. 3 is a schematic respective view of the apparatus for producing yarns according to the present invention.

Another embodiment of an apparatus for producing yarns according to the present invention is illustrated in FIG. 3, wherein a group of yarns moving via the yarn cutting and sucking device 17-A pass through the yarn separating guide 13-A of the yarn separating guide 13 disposed on the side of the second yarn feed roller 12 and run around the first yarn feed roller 11. Another group of yarns moving via the yarn cutting and sucking device 17-B pass through the yarn separating guide 13-B of the yarn separating guide 13 on the side opposite to the second yarn feed roller 12 and run around the first yarn feed roller 11, as shown in FIGS. 4 and 5.

Figure 4:
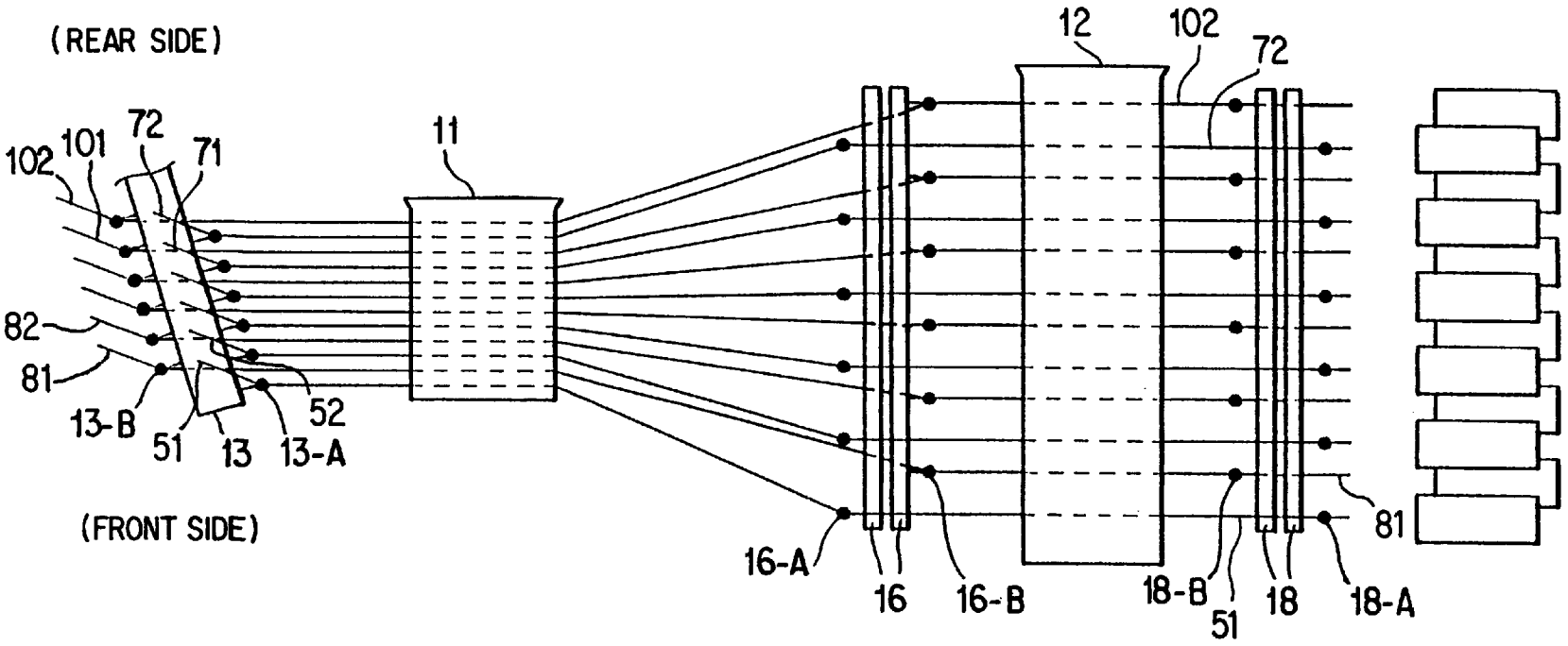
FIG. 4 is a view of yarn paths in another embodiment of the apparatus for producing yarns according to the present invention.
Figure 5:
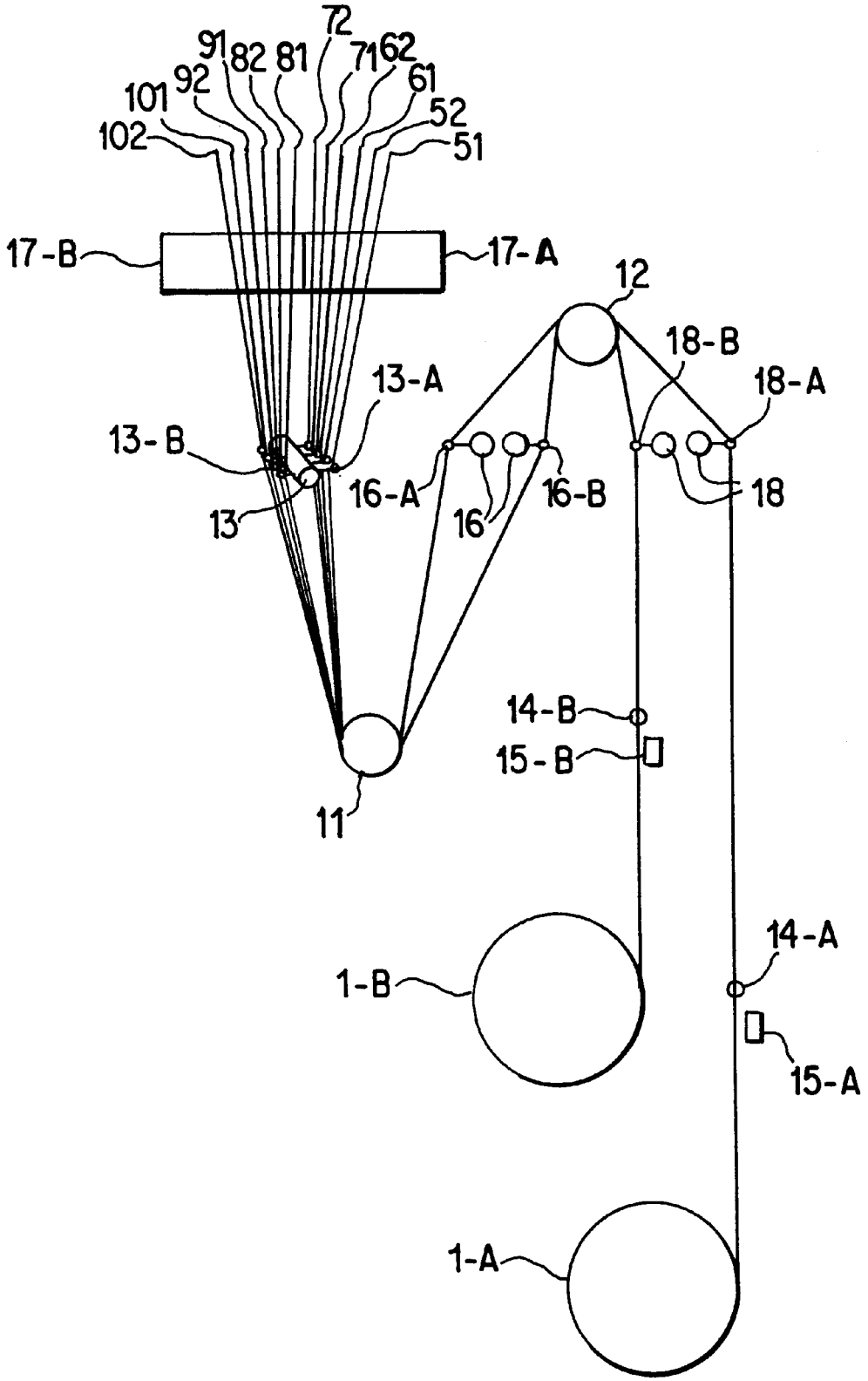
FIG. 5 is a view of the apparatus shown in FIG. 4.

As best seen in FIG. 4, the second yarn separating guide 13-A and the frist yarn separating guide 13-B are arranged so that the respective yarns 51, 81, 52, 82, 61, 91, 62, 92, 71, 101, 72 and 102 are positioned alternately in this order prior to entering the first yarn feed roller 11. The yarn separating guide 13 (13-A and 13-B) also functions in much the same manner as the first and second yarn path control guides. After the respective yarns have exited the first yarn feed roller 11 and before they have entered the second yarn feed roller 12, the yarn path of the one group of yarns 51 to 72 is controlled by the third guides 16-A of the first yarn path control guide 16 provided on one side thereof, and the yarn path of the other group of yarns 81 to 102 is controlled by the fourth guides 16-B provided on the other side. After the respective yarns have exited the second feed roller 12, the yarn path of the one group of yarns 51 to 72 is controlled by the sixth set guides 18-A of the second yarn path control guide 18 provided on one side thereof, and the yarn path of the other group of yarns 81 to 102 is controlled by the fifth set of guides 18-B of the second yarn path control guide 18 on the other side thereof.

The positioning of the yarn separating guides, first and second yarn feed rollers, and first and second yarn path control guides will now be described in greater detail with reference to FIG. 4. The second yarn separating guides 13-A are inside guides and the first yarn separating guides 13-B are outside guides with respect to the first yarn feed roller 11. The third yarn path control guides 16-A are inside guides and the fourth yarn path control guides 16-B are outside guides with respect to the first feed roller 11. The fourth yarn path control guides 16-B are inside guides and the third yarn path control guides 16-A are outside guides with respect to the second yarn feed roller 12. The fifth yarn path control guides 18-B are inside guides and the sixth yarn path control guides 18-A are outside guides with respect to the second yarn feed roller 12. Thus, consideration of the third 16-A and fourth 16-B guides of the first yarn path control guide 16 as being inside or outside guides is determined by the particular reference to either the first 11 or second 12 yarn feed roller. After exiting the second yarn feed roller 12, the respective yarns 51 to 72 in the one group pass through the sixth guide 18-A of the second yarn path control guide 18 and the respective yarns 81 to 102 in the other group of yarns pass the fifth guide 18-B of the second yarn path control guide 18. The yarns are then wound by the winders 1-A and 1-B, respectively.

If at least one yarn, for example, a yarn 92 wound by the winder 1-B has been broken during the normal winding operation, the yarn breakage detector 15-B provided for this yarn 92 detects the yarn breakage and informs this fact to the controller (not shown). The controller promptly causes the corresponding yarn cutting and sucking device 17-B to operate to cut the yarns 81 to 102 belonging to the same group and suck the same thereinto so that no trouble occurs in the other part of the yarn spinning apparatus. It will be apparent that all the yarns to be wound by the winder 1-B are cut at this instant.

There might be an extremely small amount of yarn pieces wound on a running path of the yarn 92 around the first yarn feed roller 11 or the second yarn feed roller 12 due to conditions whereby the yarn breakage has been generated. The wound yarn pieces, however, can be easily pushed toward the front side (i.e., to a distal end of the roller), for example, by a bamboo spatula and removed from the roller without disturbing the group of yarns 51 to 72 being wound. Accordingly, it is possible to continue the normal winding operation by the winder 1-A even though the winding operation of the winder 1-B has been interrupted due to the yarn breakage.

Now, it is necessary to exchange incomplete yarn packages on the winder 1-B caused by the yarn breakage with fresh empty tubes and thread the yarns thereon immediately. At this time, the group of yarns 51 to 72 belonging to the winder 1-A are running through the first yarn feed roller 11 and the second yarn feed roller 12. Therefore, the yarns 81 to 102 belonging to the winder 1-B must be located at positions alternate with those 51 to 72 belonging to the winder 1-A without disturbing the latter.

Also in this case, the threading operation can be smoothly carried out as described before, irrespective of existence of the group of yarns running in the front side region.

That is, the group of yarns 81 to 102 sucked into the yarn cutting and sucking device 17-B are sucked together by the suction gun (not shown). The suction gun is displaced in the running direction of the first yarn feed roller 11 while maintaining the respective yarns in the predetermined positions in the section 13-B of the yarn separating guide 13, until reaching the yarn path control guide 16, at which the respective yarns are threaded into the predetermined position in the section 16-B. At this time, the respective yarns laterally move along the first yarn feed roller 11 to pass over the group of yarns normally being wound, into the predetermined positions. After the yarns are threaded to the group or guides in the section 16-B, the suction gun is displaced in the running direction of the second yarn feed roller 12 and made to stop at a position somewhat exceeding the traverse motion fulcrum guide 18. On the second yarn feed roller 12, the group of yarns 81 to 102 laterally moves therealong to pass under the group of yarns normally being wound, by pushing the guides 16-A and 16-B at the same time into the predetermined position. Since both the groups of yarns run at the same speed and at an angle therebetween, the yarns are immediately positioned at normal positions without the occurrence of tangling or any filament breakage in the respective yarn. Then, the operator threads the respective yarn into the traverse motion fulcrum guide 14-B to start the winding operation of the winder 1-B.

In such a manner, the winder I-B is made to restart.

Figure 6:
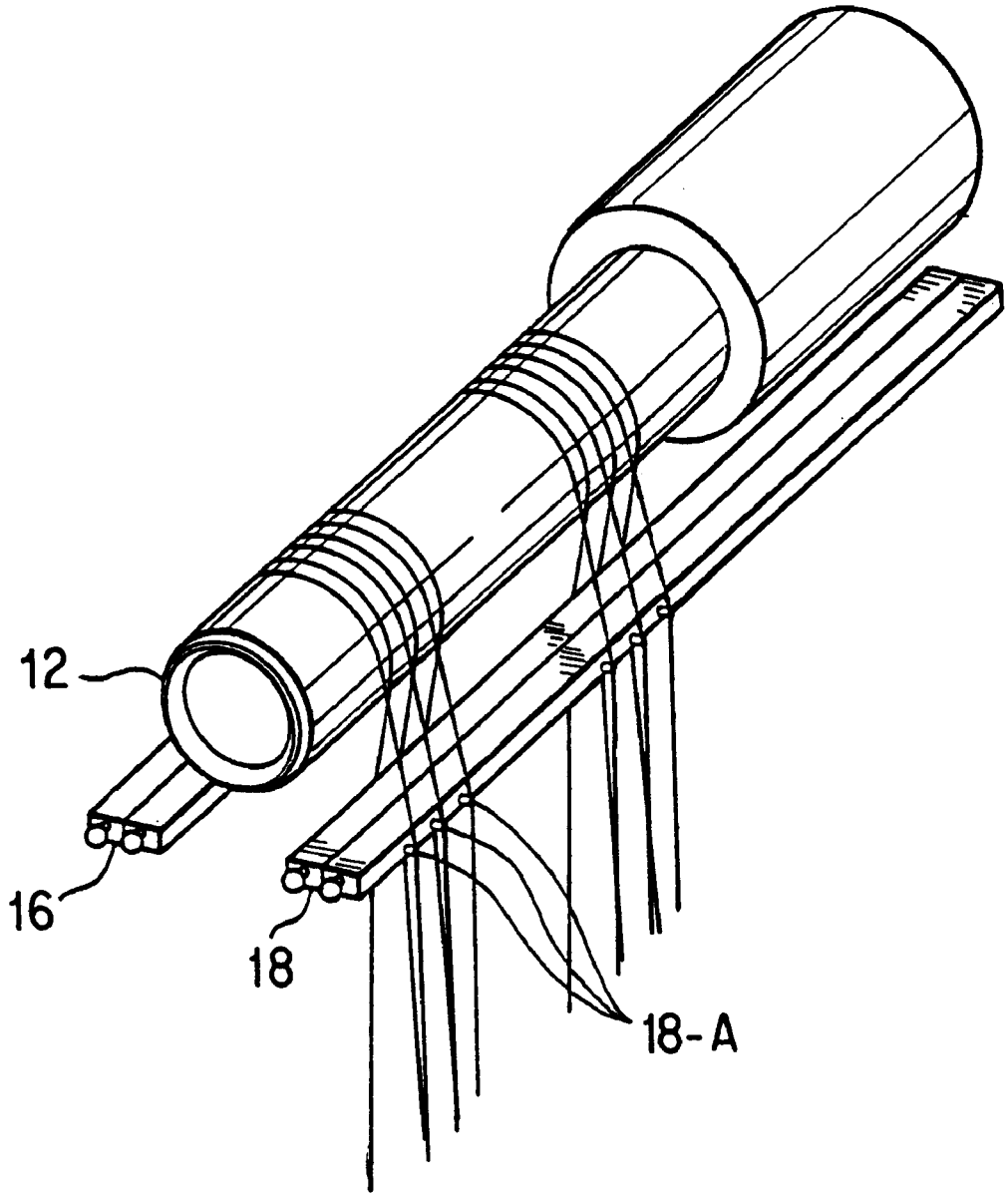
FIG. 6 is a schematic respective view of a yarn path control guide disposed at a different position.
Figure 7:
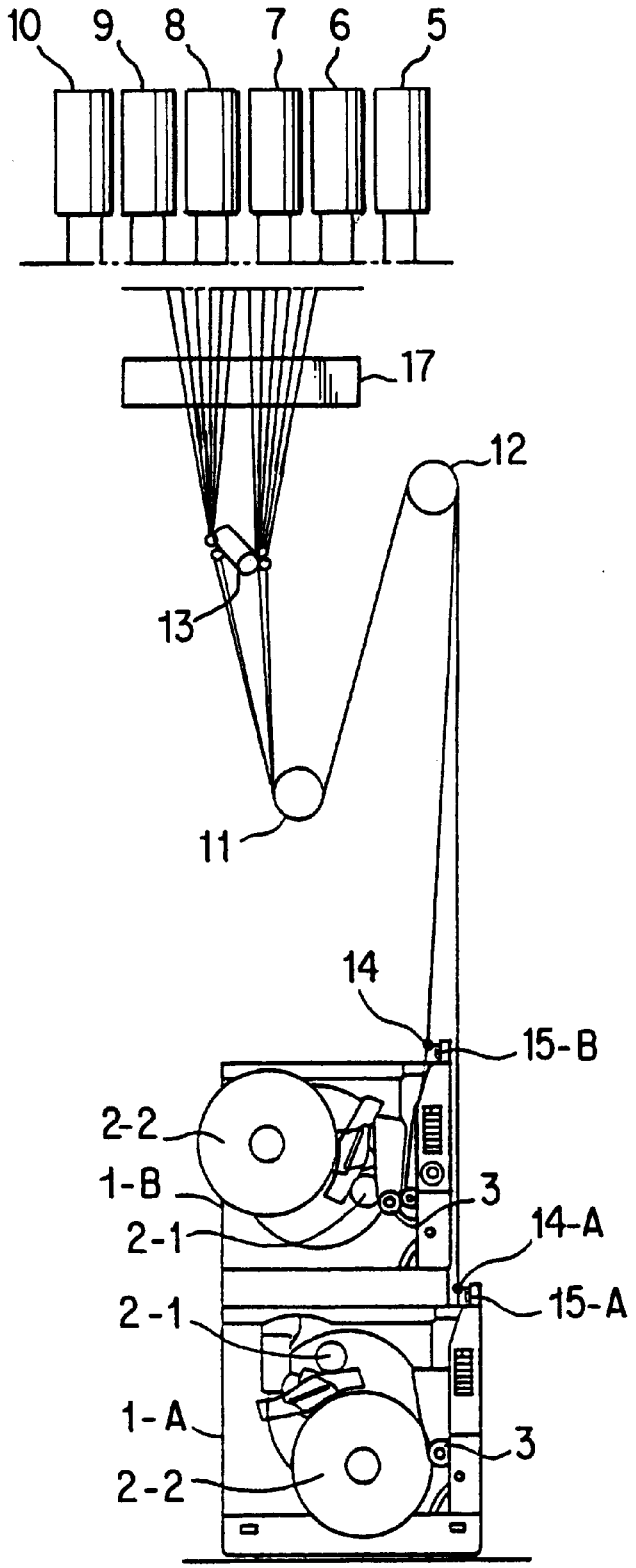
FIG. 7 is a schematic respective view of a conventional apparatus for producing yarns.

As seen in FIG. 3, the yarn paths on the second yarn feed roller 12 are defined in a generally middle region in a space occupied by the respective packages in the axial direction. If the distance between the first yarn feed roller 11 and the yarn control guide 16 or between the second yarn feed roller 12 and the winder fanning guide is so short that the yarns 52 and 102 running in the opposite end yarn paths have an excessively large braking angle from a center line, the second yarn path control guide 18 may be provided as shown in FIG. 6 in the vicinity of the second yarn feed roller 12. The yarns enter the respective traverse motion fulcrum guides 14 via the second yarn path control guide 18 so that the yarn running conditions such as running angle, traverse length or others become optimum even though the profile take-up machine.

In the embodiment shown in FIG. 1, the yarn exiting the second yarn feed roller 12 directly reaches the traverse motion fulcrum guide 14. However, a second yarn path control guide may be disposed at a position between the traverse motion fulcrum guide 14 and the second yarn feed roller 12 closer to the latter.

In such a case, the distance between the winder and the second yarn feed roller can be reduced compared with the first embodiment, which facilitates the threading operation and minimizes a machine height to reduce the size of the apparatus.

Even in a case wherein winders are superposed with each other to form a vertical row arrangement, it is possible to reduce a total height of the apparatus for producing yarns as well as an installation space compared with the prior art apparatus.

According to the apparatus for producing yarns of the present invention, since the respective one yarn cutting and sucking device and the respective one winder form winding units, and at least two winding units share at least one of the yarn feed rollers, the number of yarns to be cut and sucked when the yarn breakage has occurred is reduced to improve the yield of the yarns and mitigate the operator's load due to the threading operation. On the contrary, in the prior art, if at least one yarn in a group of yarns processed in the same apparatus has been broken, all the yarns including those belonging to the winder continuing the normal winding operation must be cut and sucked, as waste, to lower the yield.

According to the apparatus of the present invention wherein the winders are arranged in a vertical row, it is possible to save the installation space of the apparatus. According to the apparatus of the present invention, yarn path control guides are provided for guiding a first yarn group to be threaded from the front side region to the rear side region while passing under or over a second yarn group which is the front side yarn group running across the first common yarn feed roller and then passing over or under the second yarn group running across the second common yarn feed roller, for the purpose of carrying out the threading operation in the inner side yarn group while crossing the front side yarn group, for example, due to the yarn breakage generating in the rear side yarn group. Thereby, it is possible to reduce the distance between the winder and the second yarn feed roller and therefore facilitate the threading operation. Also, it is possible to reduce a total height of the apparatus, which enables the elimination of an intermediate floor for the threading operation.

What is claimed is:

1. An apparatus for producing yarns comprising:

a spinning device having spinning packs for extruding molten polymer to form first and second groups of yarns;

at least one yarn feeding roller for feeding the first and second groups of yarns;

a first winder having a spindle for winding the first group of yarns on tubes arranged on said spindle of the first winder;

a second winder having a spindle for winding the second group of yarns on tubes arranged on said spindle of said second winder, said first and second winders being arranged to receive said first and second groups of yarns commonly from said at least one yarn feeding roller;

a first yarn breakage detector arranged between said at least one yarn feeding roller and said first winder for detecting breakage of at least one of the yarns belonging to the first group of yarns;

a second yarn breakage detector arranged between said at least one yarn feeding roller and said second winder for detecting breakage of at least one of the yarns belonging to the second group of yarns;

a first yarn cutting and sucking device disposed between said spinning device and said at least one yarn feeding roller and operative in response to a yarn breakage detection signal to cut and suck said first group of yarns;

a second yarn cutting and sucking device disposed between said spinning device and said at least one yarn feeding roller and operative in response to a yarn breakage detection signal to cut and suck said second group of yarns;

wherein said first yarn cutting and sucking device and said first winder form a first winding unit, said second yarn cutting and sucking device and said second winder form a second winding unit, and said first and second winding units share said at least one yarn feeding roller; and at least one yarn path control guide arranged near said at least one yarn feeding roller and including a first set of guide elements for guiding the first group of yarns and a second set of guide elements for guiding the second group of yarns so that yarns of said first and second groups are alternately positionable along the length of said at least one feeding roller, one of said first and second sets of guide elements being movable while the other of said first and second sets of guide elements are guiding the corresponding group of yarns.

2. An apparatus for producing yarns according to claim 1, wherein the winders are arranged in a vertical row.

3. An apparatus for producing yarns according to claim 1, wherein said at least one yarn feeding roller comprises first and second yarn feeding rollers arranged in series; and wherein said first group of yarns is positionable on a front side of said at least one yarn path control guide and said second group of yarns is positionable on a rear side of said at least one yarn path control guide, said at least one yarn path control guide being positioned relative to the first and second yarn feeding rollers so that upon the occurrence of a yarn breakage in the first group of yarns and subsequent threading operation of the first group of yarns, the first group of yarns is movable from a front side region of the first yarn feeding roller towards a rear side region of the first yarn feeding roller while passing under the second group of yarns on the first yarn feeding roller and is then movable from a front side region of the second yarn feeding roller towards a rear side region of the second yarn feeding roller while passing over the second group of yarns on the second yarn feeding roller.

4. An apparatus for producing yarns according to claim 3, wherein upon the occurrence of a yarn breakage in the second group of yarns and subsequent threading operation of the second group of yarns, the second group of yarns is movable from the front side region of the first yarn feeding roller towards the rear side region of the first yarn feeding roller while passing over the first group of yarns on the first yarn feeding roller and is then movable from the front side region of the second yarn feeding roller towards the rear side region of the second yarn feeding roller while passing under the first group of yarns on the second yarn feeding roller.

5. An apparatus for producing yarns according to claim 1, further comprising a yarn separating guide having first and second guides, a first yarn path control guide having third and fourth guides, said yarn separating guide and said first yarn path control guide being arranged on opposite sides of a first yarn feeding roller, wherein said first and fourth guides are arranged outside said second and third guides with respect to said first yarn feeding roller.

6. An apparatus for producing yarns according to claim 5, further comprising a second yarn feeding roller arranged in series with said first yarn feeding roller, said second and third guides forming inside guides with respect to said first yarn feeding roller and said first and fourth guides forming outside guides with respect to said first yarn feeding roller.

7. An apparatus for producing yarns according to claim 6, further comprising a second yarn path control guide having fifth and sixth guides, said second yarn feeding roller being arranged between said first yarn path control guide and said second yarn path control guide, said fourth and fifth guides forming inside guides with respect to said second yarn feeding roller, said third and sixth guides forming outside guides with respect to said second yarn feeding roller.

8. An apparatus for producing yarns comprising:

a spinning device having spinning packs for extruding molten polymer to form a first group of yarns and a second group of yarns;

a first yarn feeding roller and a second yarn feeding roller for feeding the first and second groups of yarns so that the first and second groups of yarns run sequentially through said first and second yarn feeding rollers;

a first yarn cutting and sucking device disposed between said spinning device and said first yarn feeding roller and operative in response to a yarn breakage detection signal to cut and suck said first group of yarns;

a second yarn cutting and sucking device disposed between said spinning device and said first yarn feeding roller and operative in response to a yarn breakage detection signal to cut and suck said second group of yarns;

a yarn separating guide having a first guide and a second guide;

a first yarn path control guide having a third guide and a fourth guide;

said second and third guides being arranged between the first and fourth guides with respect to said first yarn feeding roller;

said first, second, third and fourth guides and said first and second yarn feeding rollers being positioned so that said first group of yarns passes through said first guide, around said first yarn feeding roller, through said fourth guide, and around said second yarn feeding roller while said second group of yarns passes through said second guide, around said first yarn feeding roller, through said third guide and around said second yarn feeding roller;

a first winder having a first spindle for winding the first group of yarns on tubes arranged on said first spindle of said first winder;

a second winder having a second spindle for winding the second group of yarns on tubes arranged on said second spindle of said second winder;

a first yarn breakage detector arranged between said first and second yarn feeding rollers and said first winder for detecting breakage of at least one yarn of the first group of yarns;

a second yarn breakage detector arranged between said first and second yarn feeding rollers and said second winder for detecting breakage of at least one yarn of the second group of yarns; and said first yarn cutting and sucking device and said first winder forming a first winding unit, said second yarn cutting and sucking device and said second winder forming a second winding unit, and said first and second winding units sharing said first and second yarn feeding rollers.

9. An apparatus for producing yarns according to claim 8, further comprising:

a second yarn path control guide having a fifth guide and a sixth guide;

said fifth guide being positioned between said second yarn feeding roller and said second winder;

said sixth guide being positioned between said second yarn feeding roller and said first winder;

said fifth guide and said fourth guide being arranged between said sixth guide and said third guide; and said fifth and sixth guides being positioned so that said first group of yarns further passes through said sixth guide and said second group of yarns further passes through said fifth guide.

10. An apparatus for producing yarns according to claim 8, wherein said first or second group of yarns continues to be wound on said tubes upon the yarn-breakage of the other of said first or second group of yarns and during the subsequent threading operation of the broken group of yarns.

* * * * *